United States Patent [19]

Hachisuka

[11] 4,209,165

[45] Jun. 24, 1980

[54] WORKBENCH FOR SIMULTANEOUSLY CUTTING A PLURALITY OF PATTERNS FROM A PLURALITY OF LAYERS OF OVERLAPPING MATERIAL

[76] Inventor: Hidehiro Hachisuka, 1-2 Nishiimagawa-cho, Higashisumiyoshi-ku, Osaka, Japan

[21] Appl. No.: 938,000

[22] Filed: Aug. 30, 1978

[51] Int. Cl.[2] ..... B25B 11/00
[52] U.S. Cl. ..... 269/54.5
[58] Field of Search ..... 269/54.4, 54.5, 95

[56] References Cited

U.S. PATENT DOCUMENTS

| | | | |
|---|---|---|---|
| 1,462,101 | 7/1923 | Colson | 269/95 |
| 2,372,779 | 4/1945 | Herman et al. | 269/54.5 |
| 2,378,423 | 6/1945 | Menchaca | 269/54.5 |

*Primary Examiner*—Robert C. Watson
*Attorney, Agent, or Firm*—Koda and Androlia

[57] ABSTRACT

A workbench for simultaneously cutting a plurality of patterns from a plurality of layers of overlapping material including a bench top made from a magnetically adhering material and having a plurality of holes therethrough at predetermined intervals and a plurality of needle holding members made from a magnetically adhering material for holding needles and which fit into said holes and magnetically adhered to said bench top.

3 Claims, 3 Drawing Figures

WORKBENCH FOR SIMULTANEOUSLY CUTTING A PLURALITY OF PATTERNS FROM A PLURALITY OF LAYERS OF OVERLAPPING MATERIAL

BACKGROUND OF THE INVENTION

1. Field of the Invention

This invention relates to workbenches and more particularly to workbenches used to cut patterns from a plurality of layers of material.

2. Prior Art

In conventional workbenches utilized for simultaneously cutting the plurality of patterns from a plurality of layers of overlapping material, needle holes are formed in the bench top and square pipes are attached to the underside of the bench top adjacent the needle holes and springs are installed in the square pipes. Needles are inserted through the holes in the bench top and are maintained in an upright position by means of the springs provided in the square pipes. However, such conventional workbenches have suffered from many drawbacks. One drawback is that the springs are sometimes affected by the tension applied to the sheets of material which are overlapped. As a result, the spring moves so that the needles are moved into inclined position thereby causing the patterns on the overlapped sheets of material to slip from their matched positions. Another problem is that since such workbenches depend only on the clamping action of the tightly adhering springs to hold the needles in place, the needles cannot be held firmly in place such that they do not move up and down. Another disadvantage is that since the springs must be installed for all the needle holes provided in the workbench top, the structure of the workbench is complicated and costly.

SUMMARY OF THE INVENTION

Accordingly, it is a general object of the present invention to provide a workbench having a means for maintaining the needles in a vertical position.

It is yet another object of the present invention to provide a workbench with a means which firmly holds the needles in place such that they do not move up and down.

It is still another object of the present invention to provide a workbench which is not complicated and is inexpensive.

In keeping with the principles of the present invention, the objects are accomplished by unique workbench for simultaneously cutting the plurality of patterns from a plurality of layers overlapping material. The workbench includes a bench top made from a magnetically adhering material having a plurality of holes therethrough at a predetermined interval and a plurality of needle holding members made from a magnetically adhering material for holding needles and which fit into said holes and magnetically adhered to said bench top.

BRIEF DESCRIPTION OF THE DRAWINGS

The above-mentioned features and objects of the present invention will become more apparent with reference to the following description taken in conjunction with the accompanying drawings wherein like reference numerals denote like elements, and in which.

DETAILED DESCRIPTION OF THE INVENTION

Referring more particularly to the drawings, shown in the Figures is a workbench in accordance with the teachings of the present invention. The workbench 4 includes legs 1 coupled to a bench top 3. A plurality of needle holes 2 are drilled at desired intervals over the length and breadth of the bench top 3. The bench top 3 is a magnetic bench top and is made of either soft iron or already magnetized magnetic material.

Figure 1:
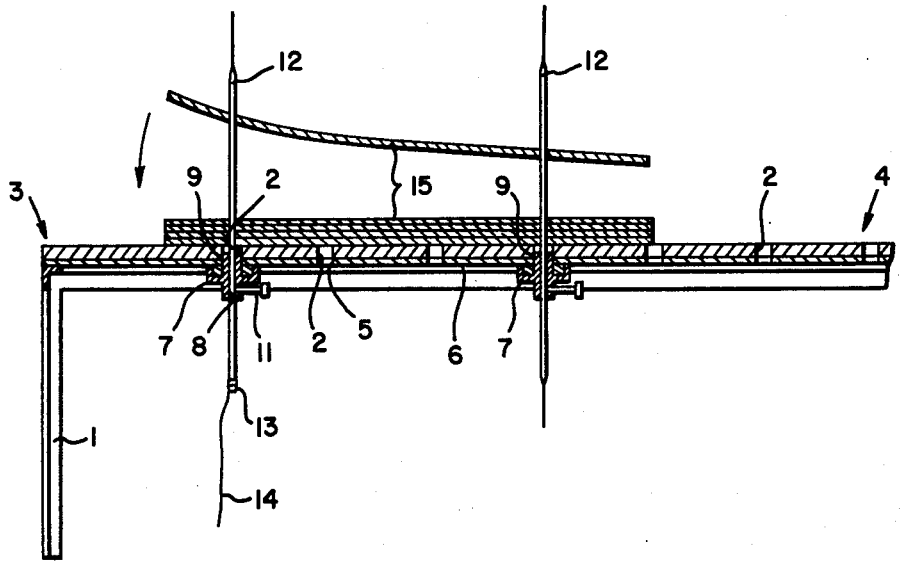
FIG. 1 is a side view of a partial longitudinal section which illustrates a workbench in accordance with the teachings of the present invention.
Figure 2:
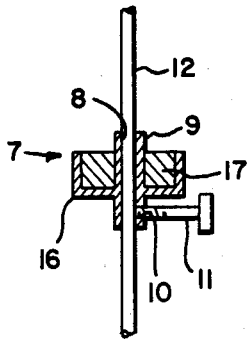
FIG. 2 is a longitudinal sectional view of a magnetically adhering part.
Figure 3:
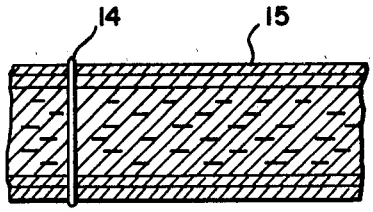
FIG. 3 is a partial cross sectional view of the sheets of the pattern material which illustrates how these sheets are overlapped.

As shown in FIGS. 1 and 2, needle holding part members 7 which have needle holding holes 8 are caused to adhere magnetically to the under side of the bench top 3. The needle holding members 7 directly adhered to the bench top 3 or an interposed plate 6 which has holes 5 in positions corresponding to the position of the needle holes 2 in the bench top 3 maybe provided between the needle holding members 7 and the bench top 3. The needle holding member 7 is provided with magnetically adhering parts. For the case with the bench top 3 is an iron plate, magnets are used as the component parts in the needle holding member 7. Furthermore, for the case with the bench top 3 is made of already magnetized magnetic material, either magnets or iron can be used as the needle holding part 7.

Each needle holding member 7 has a projecting boss 9 whose diameter corresponds to the diameter of the needle holes 2. Needle holding holes 8 pass through the projecting boss 9. Furthermore, in each needle holding member 7, a female threaded hole 10 is drilled perpendicular to the axis of the needle holding hole 8 and a tightening screw 11 is threaded into the hole 10 so that an inserted needle can be mechanically held in place.

For the case where the magnets are used as the component parts in the needle holding member 7, a ring shaped magnet 17 is caused to adhere to a cylindrical holder 16 provided on each needle holding member 7 (as shown in FIG. 2). The needles 12 pass through the needle holes 2 and the needle holding holes 8 and are held firmly in place in the needle holding holes 8 either by the magnetic force of the needle holding member 7 or by tightening of the screws 11. The projecting boss 9 of the needle holding member 7 is inserted into the needle holes 2 or into corresponding holes 5 in an interposed plate 6. The needle holding parts 7 are caused to adhere magnetically to the underside of the bench top 3 so that the needles 12 are maintained in an upright position.

Furthermore, in some situations it would be desirable and it is possible to form an eye 13 at the one end of the needle 12 and to pass a thread 14 through the eye 13 so as to tie sheets of the pattern material together after their patterns have been overlapped so that they will match.

In operation, first sheets of pattern material 14 are unfolded on the bench top 3. Next, an arbitrary number of needles 12 which correspond to conspicuous and easily remembered points in the pattern are prepared. These needles 12 are coupled to the magnetically adhering parts of the needle holding members 7 which are then attached to the underside of the bench top 3 so that the needles 12 are maintained in an upright position. The heights of the needles 12 are then adjusted by means of the tightening screws 11. Next, the sheets of pattern material are overlapped so that their patterns match. This is done by matching conspicuous points in the pattern on each sheet with the positions of the needles 12. The needles 12 can be easily removed by moving the magnetically adhering parts of the needle holding member 7. The cutting of the patterns is performed in an appropriate manner with the sheets of the patterned material overlapped as described above.

As described above, in the present invention magnetically adhering parts which hold needles adhere magnetically to a magnetic bench top on which sheets of pattern material are laid and thereby holds the needles in an upright position so that they protrude from the surface of the magnetic bench top. Accordingly, by the structure of the present invention is created a workbench which is simpler than that of conventional workbenches and it is necesary merely only to construct a number of magnetically adheriang parts corresponding to the number of needles used. As a result, the cost of manufacturing parts is sharply reduced and by removing the magnetically adhering parts from the workbench makes it possible to use the workbench for other purposes. In addition, the workbench of the present invention is much more resistant to the tipping or up and down motion of the needles due to the tension of the material, etc., than are workbenches in which needles are held in place by means of springs. Accordingly, the overlapping of patterns such that they match can be accurately maintained and pattern work is greatly facilitated.

It should be apparent to one skilled in the art that the above described embodiment is merely illustrative of but one of the many possible specific embodiments which represents the application of the principles of the present invention. Numerous and varied other arrangements can be readily devised by those skilled in the art without departing from the spirit and scope of the invention.

I claim:

1. A workbench for simultaneously cutting a plurality of patterns from a plurality of layers of overlapping material comprising:

an iron bench top;

a plurality of holes provided in said bench top at predetermined intervals; and a plurality of needle holding members made from a magneticly adhering material detachably provided on a bottom surface of said bench top, said needle holding member comprising a ring magnet.

2. A workbench for simultaneously cutting a plurality of patterns from a plurality of layers of overlapping material comprising:

an iron bench top;

a plurality of holes provided in said bench top at predetermined intervals; and a plurality of needle holding members made from a magnetically adhering material detachably provided on a bottom surface of said bench top, each of said needle holding members comprising a ring magnet, an axial hole, a boss provided at one end which fits into said plurality of holes, a threaded hole provided perpendicular to said axial hole and a screw threaded into said threaded hole.

3. A workbench according to claim 2 wherein said workbench further comprises an interposed plate provided on said bottom surface of said bench top and having a plurality of holes corresponding to said plurality of holes in said bench top.

* * * * *